US005642992A

United States Patent [19]

Shaw

[11] Patent Number: 5,642,992

[45] Date of Patent: Jul. 1, 1997

[54] MULTI-ROTOR HELICAL SCREW COMPRESSOR

[76] Inventor: David N. Shaw, 200 D Brittany Farms Rd., New Britain, Conn. 06053

[21] Appl. No.: 550,253

[22] Filed: Oct. 30, 1995

[51] Int. Cl.[6] ..... F04C 18/16

[52] U.S. Cl. ..... 418/152; 418/197; 418/201.1; 418/203

[58] Field of Search ..... 418/152, 197, 418/201.1, 202, 203

[56] References Cited

U.S. PATENT DOCUMENTS

| | | | |
|---|---|---|---|
| 2,481,527 | 9/1949 | Nilsson | 418/197 |
| 2,590,561 | 3/1952 | Montelius | 418/197 |
| 2,652,192 | 9/1953 | Chilton | 418/197 |
| 2,868,442 | 1/1959 | Nilsson | 418/152 |
| 3,275,226 | 9/1966 | Whitfield | 418/203 |
| 5,165,881 | 11/1992 | Wicen | 418/152 |

FOREIGN PATENT DOCUMENTS

| | | | |
|---|---|---|---|
| 2409554 | 9/1975 | Germany | 418/152 |
| 200349 | 4/1983 | Germany | 418/201.1 |
| 241105 | 11/1986 | Germany | 418/201.1 |
| 4203383 | 7/1992 | Japan | 418/152 |
| 74114 | 4/1930 | Sweden | 418/197 |
| 452760 | 8/1936 | United Kingdom . | |
| 648055 | 12/1950 | United Kingdom | 418/197 |

OTHER PUBLICATIONS

Socio–Tech, Mitsubishi–*Melco Water Cooled Large Screw Chilling Unit.*

Hitachi–SRM Refrigerating Semi–Hermetic Screw Compressors.

*Primary Examiner*—John J. Vrablik

*Attorney, Agent, or Firm*—Fishman, Dionne, Cantor & Colburn

[57] ABSTRACT

A compressor in accordance with the present invention includes a male rotor which is axially aligned with and in communication with two female rotors. The male rotor is driven by a motor, in other words the male rotor is the drive rotor. The male rotor has a plurality of lobes which intermesh with a plurality of flutes on each of the female rotors. The male rotor comprises an inner cylindrical metal shaft with an outer composite material ring mounted thereon. The ring includes the lobes of the male rotor integrally depending therefrom. The lobes of the male rotor being comprised of a composite material allows positioning of the female rotors at a small clearance from the male drive rotor. This clearance is small enough that the liquid refrigerant itself provides sufficient sealing, cooling and lubrication. The positioning of the female rotors on opposing sides of the male rotor balances the radial loading on the male rotor thereby minimizing radial bearing loads. The interface velocity between the male and female rotors during operation is low, whereby damage suffered as a result of lubrication loss is reduced. The compressor includes a housing having an inlet housing portion, a main housing portion and a discharge housing portion. An induction side plate and a discharge side plate are mounted on the male rotor. The outside diameter of the induction plate is equal to the root diameter of the male rotor. The outside diameter of the discharge plate is equal to the crest diameter of the male rotor. These plates serve two purposes, to secure the male rotor components and to equalize suction pressure at both ends of the male rotor, thereby virtually eliminating the thrust loads. Discharge porting is defined in the discharge housing portion wherein trap pocket relief is provided.

13 Claims, 8 Drawing Sheets

MULTI-ROTOR HELICAL SCREW COMPRESSOR

BACKGROUND OF THE INVENTION

The present invention relates to helical screw type compressors. More specifically, the present invention relates to a multi-screw compressor having, e.g., a male rotor and at least two female rotors.

Helical type compressors are well known in the art. One such helical compressor employs one male rotor axially aligned with and in communication with one female rotor. The pitch diameter of the female rotor is greater than the pitch diameter of the male rotor. Typically, the male rotor is the drive rotor, however compressors have been built with the female rotor being the drive rotor. The combination of one male rotor and one female rotor in a compressor is commonly referred to as a twin screw or rotor, such is well know in the art and has been in commercial use for decades. An example of one such twin rotor commonly employed with compressors in the HVAC (heating, ventilation and air conditioning) industry is shown in FIG. 1 herein, labeled prior art. Referring to FIG. 1 herein, a cross sectional view of a male rotor 10 which drives an axially aligned female rotor 12 is shown. Male rotor 10 is driven by a motor, not shown, as is well known. Male rotor 10 has four lobes 14–17 with a 300° wrap and female rotor 12 has six flutes 18–23 with a 200° wrap. Accordingly, the compression-discharge phase of the axial sweep with respect to male rotor 10 occupies 300° of rotation, with the timing between the closed discharge port and the closed suction port occupying the remaining 60° of rotation. The resulting gap between the male and female rotors requires oil to be introduced into the compression area for sealing, however, the oil also provides cooling and lubricating, as is well know. However, the introduction of this oil requires the use of an oil separation device, to separate the oil from the refrigerant being compressed in HVAC compressors. The primary benefit of the twin rotor configuration is the low interface velocity between the male and female rotors during operation. However, the twin rotor configuration is not balanced and therefore incurs large radial bearing loads and thrust loads. The obvious solution to alleviating the beating load problem would be to install sufficiently sized beatings. This is not a feasible solution, since the relative diameters of the rotors in practice result in the rotors being too close together to allow installation of sufficiently sized bearings.

The prior art has addressed this problem, with the introduction of compressors employing 'so-called' single screw technology. Referring to FIGS. 2 and 3 herein, labeled prior art, a drive rotor 24 with two opposing axially perpendicular gate rotors 26 and 28 is shown. Rotor 24 is driven by a motor, not shown, as is well known. Rotor 24 has six grooves 30 and each gate rotor 26, 28 has eleven teeth 32, 34, respectively, which intermesh with grooves 30. The gate rotors 26 and 28 are generally comprised of a composite material which allows positioning of the gate rotor at a small clearance from the drive rotor. This clearance is small enough that the liquid refrigerant itself provides sufficient sealing, the liquid refrigerant also provides cooling and lubrication. The rearward positioning of gate rotors 26 and 28 and the positioning on opposing sides of drive rotor 24, (1) allows equalizing suction of pressure at both ends of rotor 24 thereby virtually eliminating the thrust loads encountered with the above described twin screw system and (2) balances the radial loading on rotor 24 thereby minimizing radial bearing loads. However, the interface velocity between the gate rotors and the drive rotor are very high. Accordingly, a common problem with this system is the extensive damage suffered by the rotors when lubrication is lost, due to the high interface velocities of the rotors.

SUMMARY OF THE INVENTION

The above-discussed and other drawbacks and deficiencies of the prior art are overcome or alleviated by the multi-rotor compressor of the present invention. In accordance with the present invention, the compressor includes a male rotor which is axially aligned with and in communication with at least two female rotors. The male rotor is driven by a motor, in other words the male rotor is the drive rotor. The male rotor has a plurality of lobes which intermesh with a plurality of flutes on each of the female rotors. The pitch diameters of the female rotors are now less than the pitch diameter of the male rotor.

The male rotor comprises an inner cylindrical metal shaft with an outer composite material ring mounted thereon. The ring includes the lobes of the male rotor integrally depending therefrom. The lobes of the male rotor being comprised of a composite material allows positioning of the female rotors at a small clearance from the male drive rotor. This clearance is small enough that the liquid refrigerant itself provides sufficient sealing, however, the liquid refrigerant also provides cooling and lubrication.

The positioning of the female rotors on opposing sides of the male rotor balances the radial loading on the male rotor thereby minimizing radial bearing loads. Further, due to a larger diameter male drive rotor as compared to the male drive rotor in the prior art twin screw compressors, and therefore, additional distance between the rotors, any female radial bearing loads can be further minimized with sufficiently sized bearings. It will also be appreciated, that interface velocity between the male and female rotors during operation is very low, whereby the extensive damage suffered by the prior art single screw compressors when lubrication is lost, due to the high interface velocities of the rotors, is reduced.

The compressor includes a housing having an inlet housing portion, a main housing portion and a discharge housing portion. An induction side plate and a discharge side plate are mounted on the male rotor. The outside diameter of the induction plate is equal to the root diameter of the male rotor. The outside diameter of the discharge plate is equal to the crest diameter of the male rotor. These plates serve two purposes, to secure the male rotor components and to equalizes suction pressure at both ends of the male rotor, thereby virtually eliminating the thrust loads encountered with the prior art twin screw compressors. Discharge porting is defined in the discharge housing portion wherein trap pocket relief is provided. p The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 4:
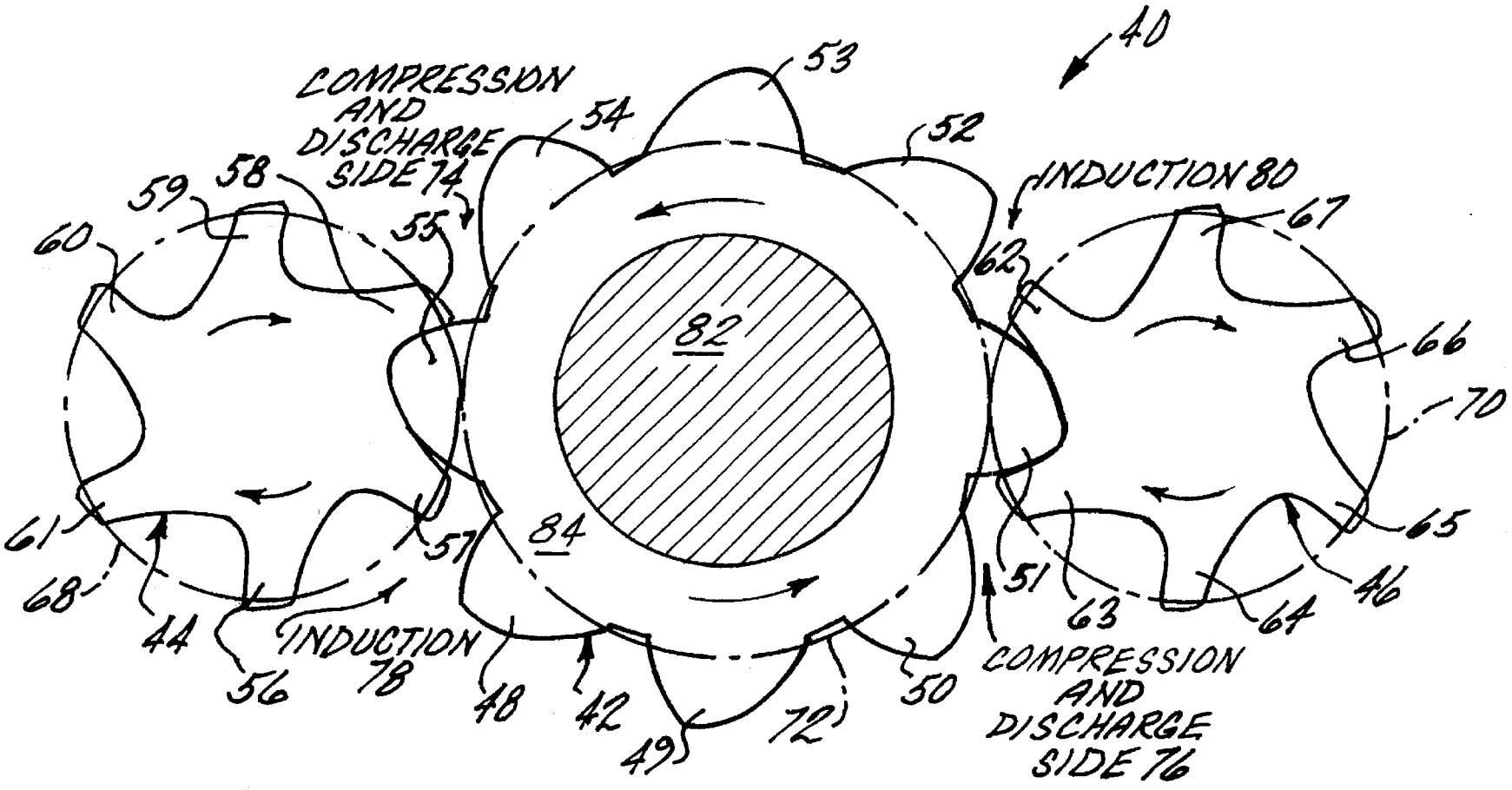
FIG. 4 is a diagrammatic cross sectional view of a tri-rotor configuration in accordance with the present invention.

Referring now to FIG. 4, a cross sectional view of a rotor configuration for use in compressors in accordance with the present invention is generally show at 40. A male rotor 42 is axially aligned with and in communication with female rotors 44 and 46. Male rotor 42 is driven by a motor, described hereinafter. In this example, male rotor 42 has eight lobes 48–55 with a 150° wrap, female rotor 44 has six flutes 56–61 with a 200° wrap, and female rotor 46 has six flutes 62–67 with a 200° wrap. The pitch diameters 68, 70 of the female rotors 44, 46 are less than the pitch diameter 72 of the male rotor 42. Accordingly, the compression phase of the axial sweep with respect to male rotor 42 occupies 150° of rotation with the timing between the closed discharge ports 74, 76 and the closed suction ports 78, 80 occupying the remaining 30° of rotation. Duplicate processes are occurring simultaneously on the top and bottom of the male rotor.

Male rotor 42 comprises an inner cylindrical metal shaft 82 with an outer composite material ring 84 mounted thereon. Shaft 82 is preferably comprised of steel, ductile iron or other material of comparable strength for supporting the rotor. Ring 84 includes lobes 48–55 integrally depending therefrom. Ring 84 is preferably comprised of a thermoplastic or other suitable composite material for use in compressors, i.e., suitable for high pressure application. The larger diameter male drive rotor as compared to the male drive rotor in the prior art twin screw compressors allows for the above described two piece construction. The smaller diameter male drive rotor in the prior art twin screw compressors could not be constructed as described above since a small diameter inner shaft would not be strong enough to properly support the rotor. The male drive rotor in the prior art moderate high pressure twin screw compressors is comprised of solid unitary metal piece. The significance of the lobes 48–55 being comprised of a composite material, is that it allows positioning of the female rotors 44 and 46 at a small clearance from the male drive rotor 42. This clearance is small enough that the liquid refrigerant itself provides sufficient sealing, however, the refrigerant also provides cooling and lubrication. Accordingly, the need to induce oil into the compression area, such as in the prior art twin screw compressors for sealing, cooling and lubricating is eliminated because the composite material can be adequately lubricated with liquid refrigerant. Further, the positioning of female rotors 44 and 46 on opposing sides of male rotor 42 balances the radial loading on male rotor 42 thereby minimizing radial bearing loads. Also, due to larger diameter male drive rotor as compared to the male drive rotor in the prior art twin screw compressors and therefore the additional distance between the rotors, any radial beating loads can be further minimized with sufficiently sized bearings. It will also be appreciated, that interface velocity between the male and female rotors during operation is very low, whereby the extensive damage suffered by the prior art single screw compressors when lubrication is lost, due to the high interface velocities of the rotors, is reduced. The low interface velocity results in minimal sliding action at the pitch band interface of the rotors.

Figure 1:
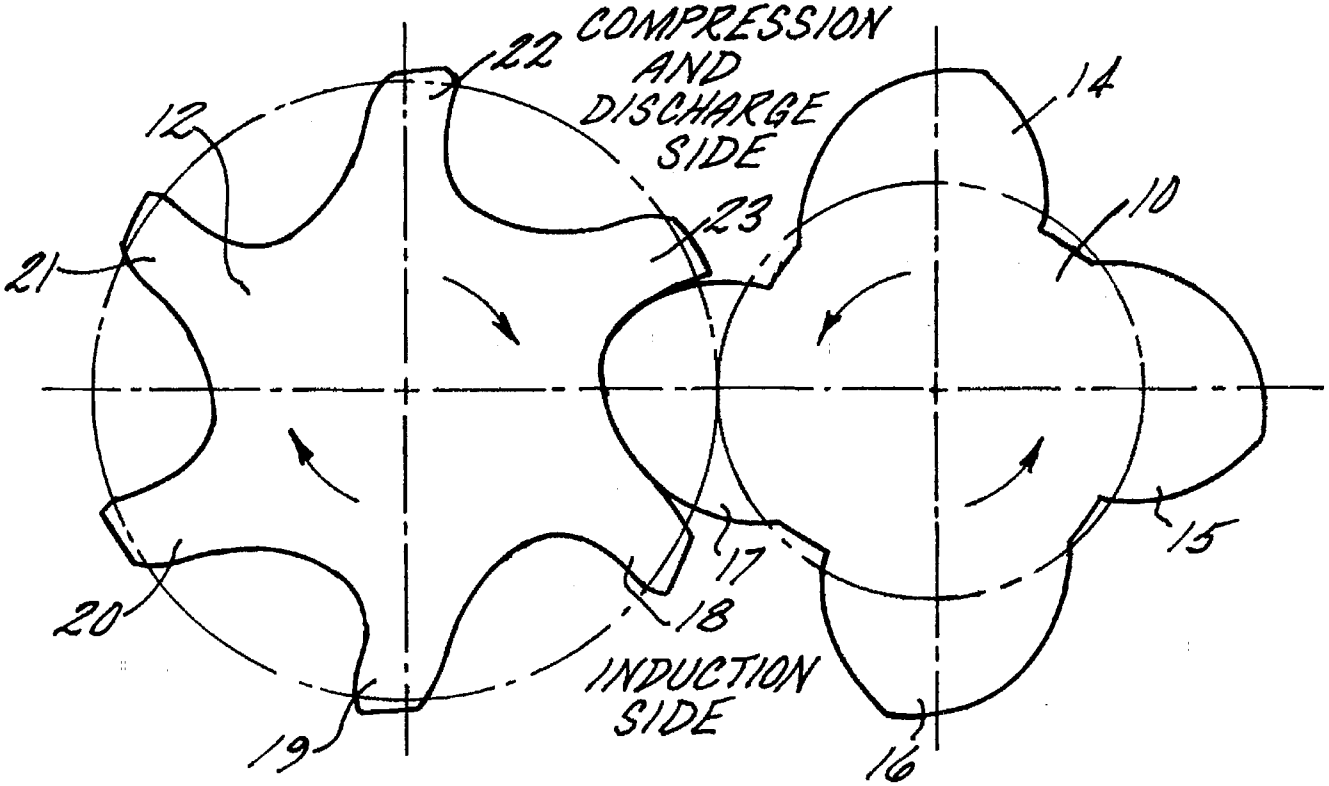
FIG. 1 (PRIOR ART)
FIG. 1 is a diagrammatic cross sectional view of a twin screw or rotor configuration in accordance with the prior art.
Figure 2:
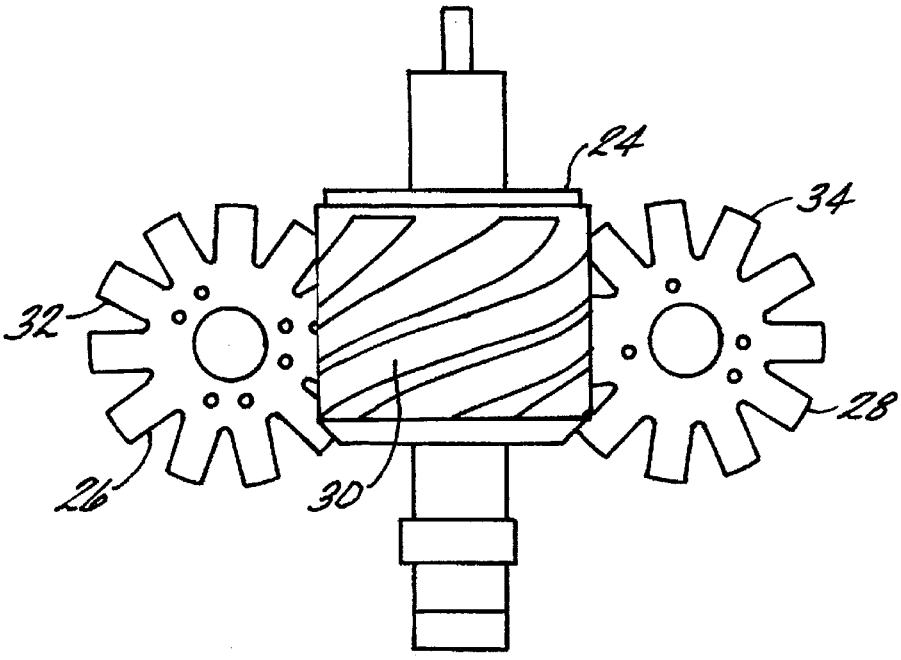
FIG. 2 (PRIOR ART)
FIG. 2 is a diagrammatic top view of a single screw configuration in accordance with the prior art.
Figure 3:
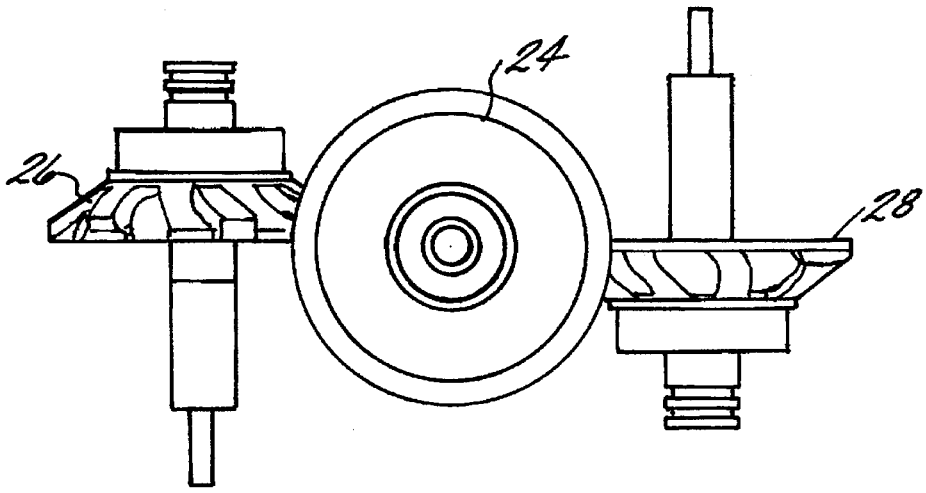
FIG. 3 (PRIOR ART)
FIG. 3 is a diagrammatic end view of the single screw configuration of FIG. 2.
Figure 5A:
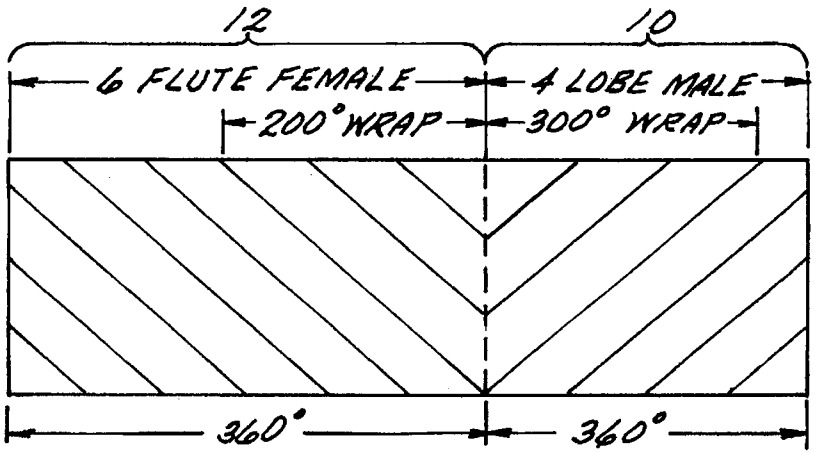
FIG. 5A (PRIOR ART)
FIG. 5A is a diagrammatic unwrapped pitch line study of the prior art twin screw or rotor configuration of FIG. 1.
Figure 5B:
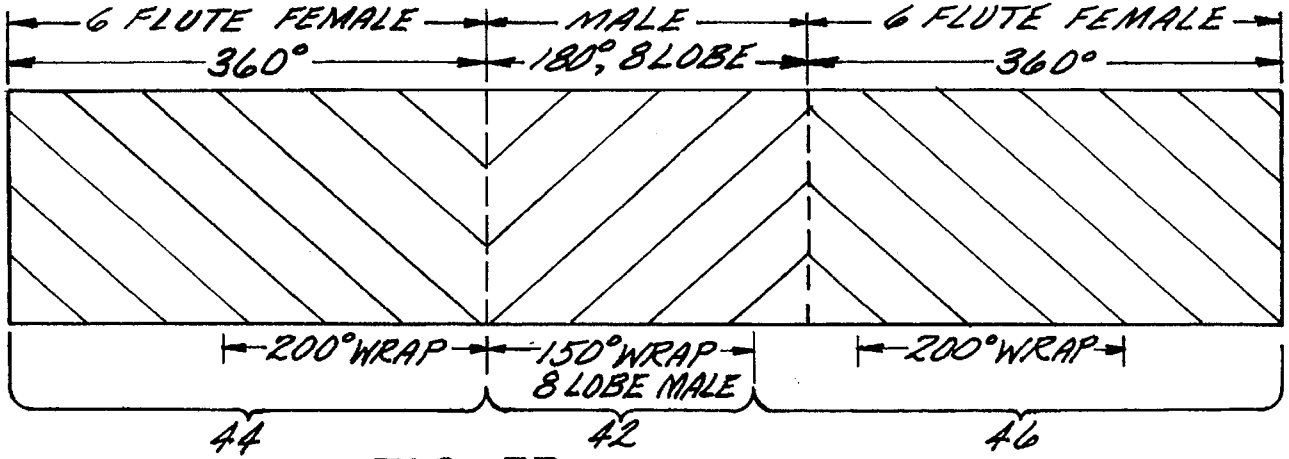
FIG. 5B is a diagrammatic unwrapped pitch line study of the tri-rotor configuration of FIG. 4.

Referring to FIGS. 5A and B diagrammatic unwrapped pitch line studies are provided. FIG. 5A is an unwrapped pitch line study of the prior art twin rotor of FIG. 1. FIG. 5B is an unwrapped pitch line study of the rotor configuration 40 of FIG. 4.

Figure 6:
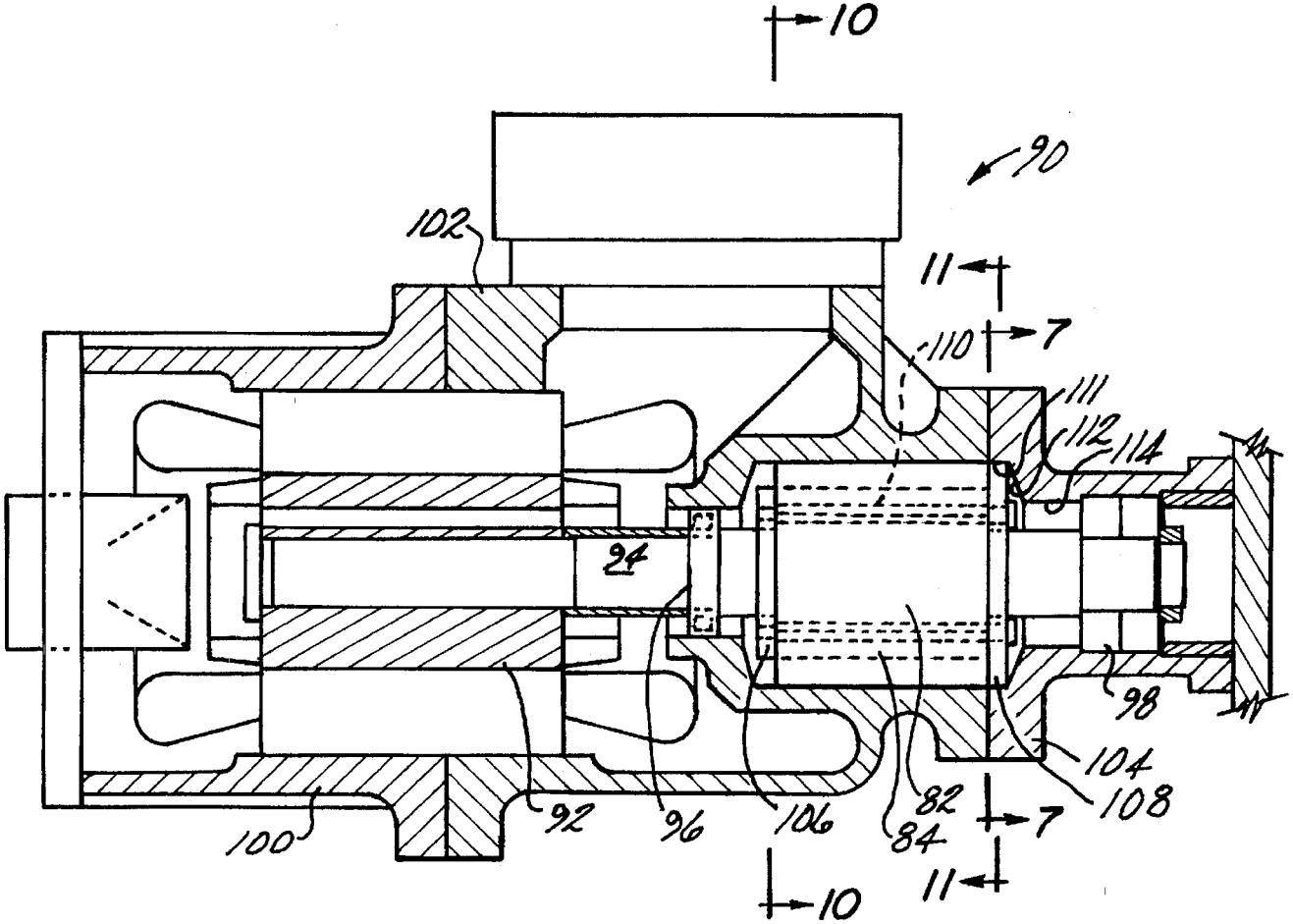
FIG. 6 is a diagrammatic side cross sectional view of a compressor employing the multi-rotor configuration of FIG. 4.
Figure 7:
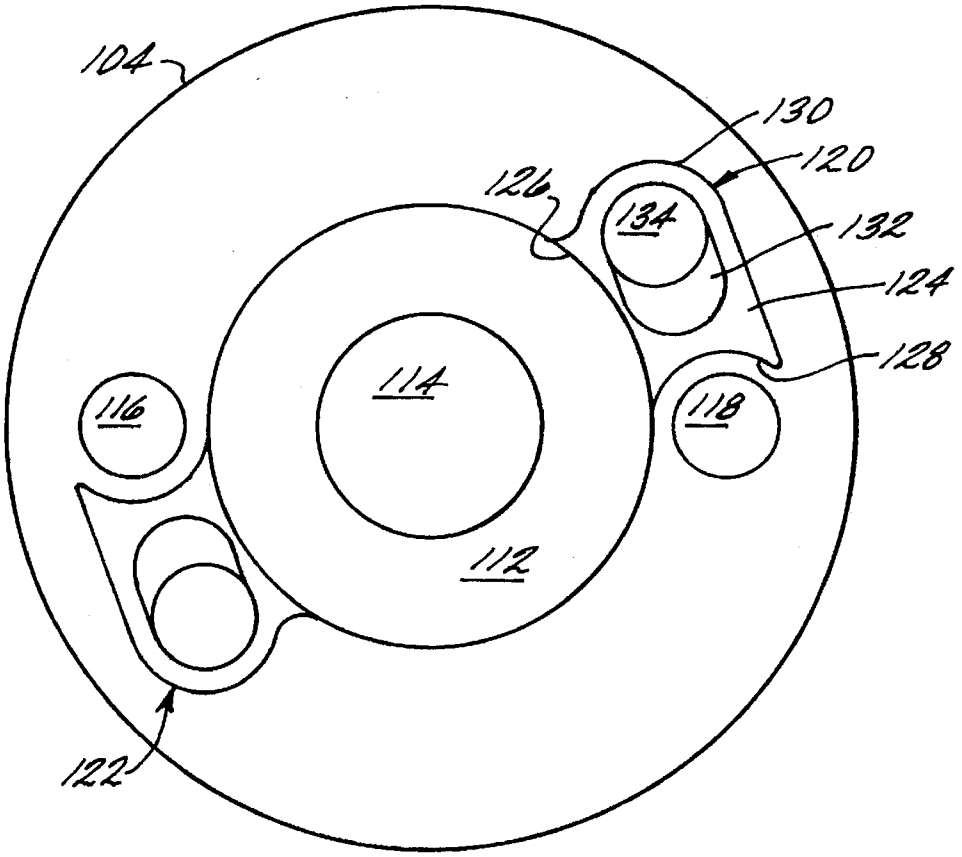
FIG. 7 is a view taken along the line 7—7 of FIG. 6 with the discharge plate removed for clarity.
Figure 10:
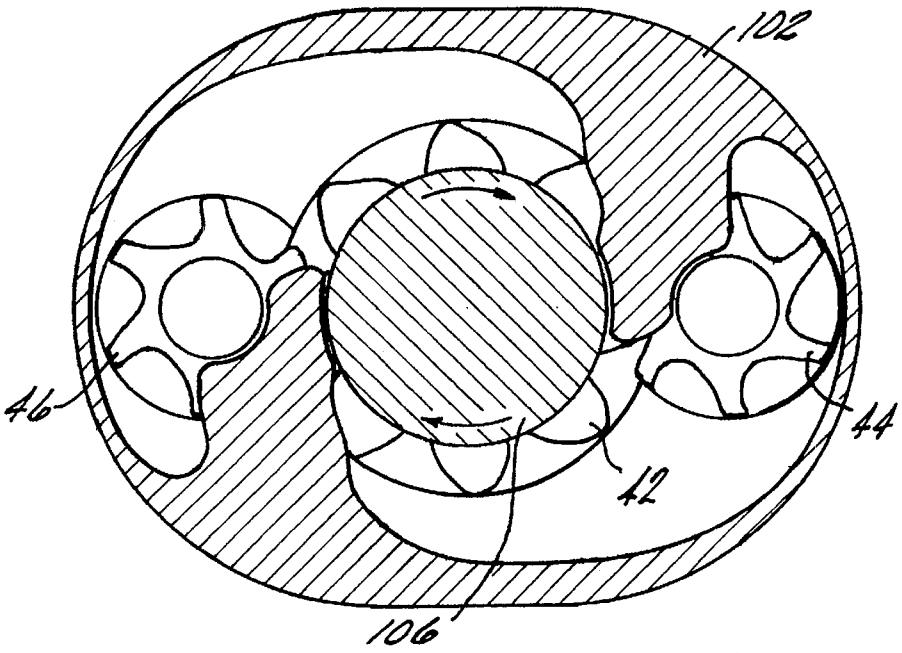
FIG. 10 is a view taken along the line 10—10 of FIG. 6.
Figure 9:
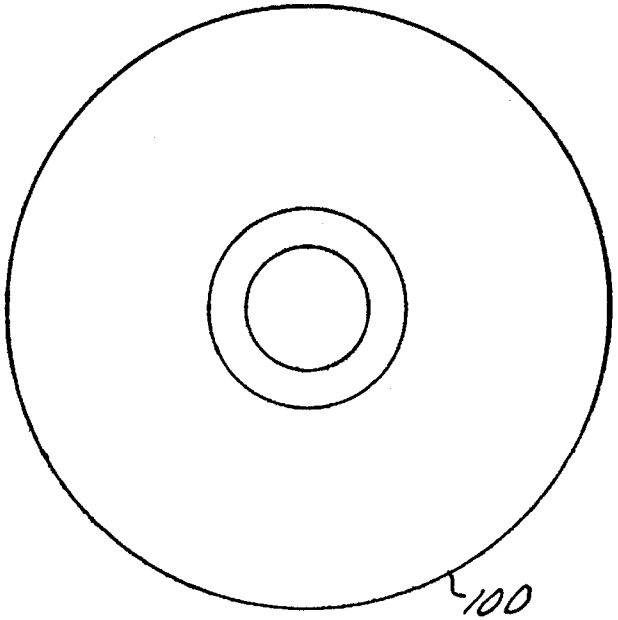
FIG. 9 is an induction end view of the compressor of FIG. 6.

Referring to FIGS. 6 and 7, a compressor employing the rotor configuration 40 of the present invention is shown generally at 90. Compressor 90 includes a hermetically sealed motor 92 having a drive shaft 94 which is integral with shaft 82 of male rotor 42 for driving the same. As described above, a beating 96 is mounted at shaft 82 in between motor 92 and rotor 42 and a bearing 98 is mounted at one end of shaft 82 to absorb any remaining radial beating loads. Bearing 96 is shown as a cylindrical roller bearing. Bearing 98 is shown as a double row angular contact ball type. Compressor 90 further comprises a housing having an inlet or induction housing portion 100, a main housing portion 102 and a discharge housing portion 104. An induction side plate 106 and a discharge side plate 108 are mounted on male rotor 42 by a plurality of dowels 110 and bolts. Induction at housing portion 100 is shown in FIG. 9 and at the induction side plate 106 is shown in FIG. 10. The center line of the dowels lies at the intersection offing 84 find shaft 82, whereby cooperating semi-circular, longitudinal grooves are formed at the outer surface of shaft 82 and the inner surface offing 84 for receiving the dowels. The outside diameter of plate 106 is equal to the root diameter of the male rotor 42. The outside diameter of plate 108 is equal to the crest diameter of the male rotor 42. Plates 106 and 108 serve two purposes, to secure ring 84 on shaft 82 and to equalize suction pressure at both ends of male rotor 42 thereby virtually eliminating the thrust loads encountered with the prior art twin screw compressors. It will be appreciated that plate 108 blocks the axial port area of the male rotor 42, however it is believed that the benefit obtained by the elimination of thrust loads (described above) outweighs the slight reduction in overall discharge port area. It should be noted that a significant portion of the axial port area of the male rotor 42 is occupied by a lobe of the rotor. Further, plate 108 having an outside diameter equal to the crest diameter of the male rotor 42 will not block the radial discharge port area of male rotor 42 or the axial discharge port areas of female rotors 44 and 46.

Discharge porting is defined in housing 104 wherein trap pocket relief is provided. The problem of a trapped pocket is well known in the art of compressors. More specifically, the trap pocket is generated as a lobe reduces the area between the two flutes, a small void between the lobe and one of the flutes traps a pocket of compressed refrigerant.

This trapped pocket of refrigerant must be relieved, otherwise the resistance generated by the trapped pocket may damage the compressor.

Figure 12:
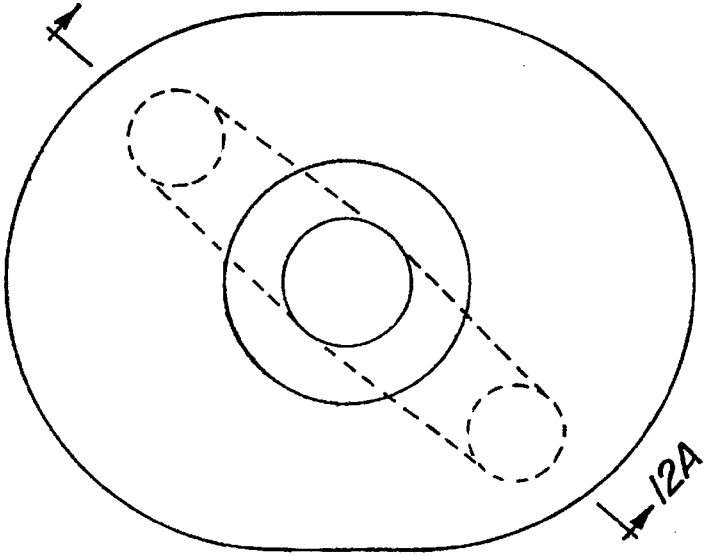
FIG. 12 is a discharge end view of the compressor of FIG. 6.
Figure 12A:
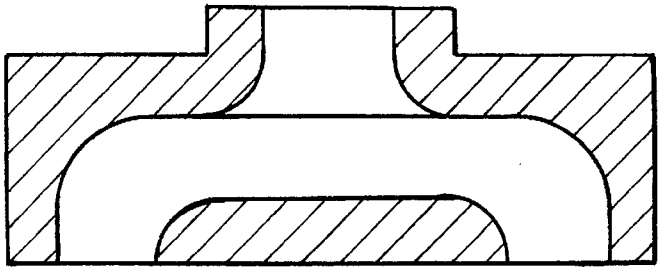
FIG. 12A is a view taken along the line 12A—12A of FIG. 12.
Figure 11:
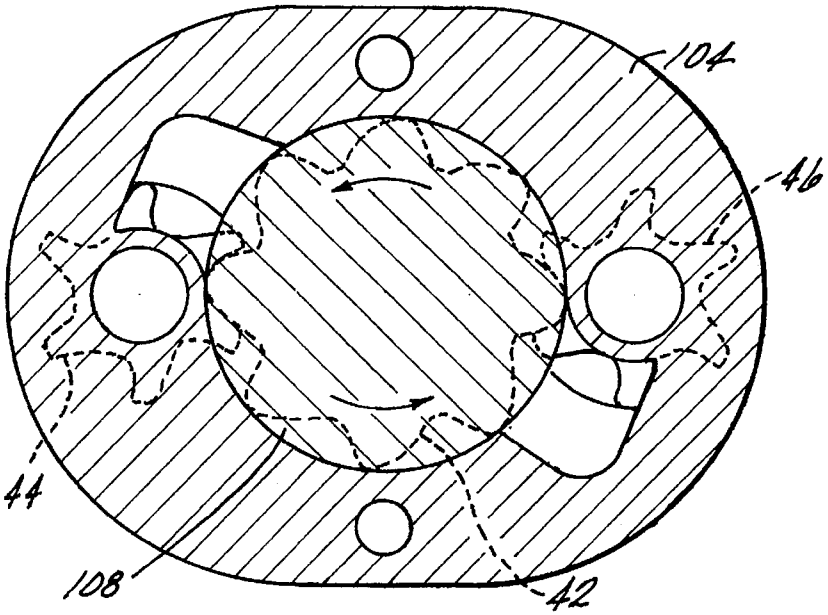
FIG. 11 is a view taken along the line 11—11 of FIG. 6.

Housing 104 includes an inner circumferential surface 111 for receiving plate 108. A clearance is defined between the outer circumference of plate 108 and the inner circumferential surface 111 of housing 104. An inwardly countersunk surface 112 depends from surface 111, which allows the clearance between plate 108 and surface 111 to be sealed by the liquid refrigerant, thereby minimizing leakage back to the low side of the compressor. Moreover, the discharge side of the male rotor 42 being sealed off from the high side by plate 108 causes the pressure on both ends of male rotor 42 to be equalized, thereby eliminating thrust loads on the male rotor. Further, as is readily apparent to one of ordinary skill in the art, the high pressure at the interface of the discharge side of the male rotor 42 and the plate 108 acts on plate 108 in the direction to the right in FIG. 6 and acts on the lobes of the male rotor 42 in an equal and opposite direction (i.e., to the left in FIG. 6). These equal and opposite forces result in the elimination of the thrust loads on the male rotor. Countersunk surface 112 terminates at an opening or hole 114 with the shaft of the male rotor 42 disposed therein. Openings or holes 116 and 118 are also provided for receiving the shafts of the female rotors 44 and 46, respectively. Compression and discharge side 74 (i.e., the corresponding radial discharge area of male rotor 42 and the axial discharge port area of female rotor 44) communicates with discharge porting 120 and compression and discharge side 76 (i.e., the corresponding radial discharge area of male rotor 42 and the axial discharge port area of female rotor 46) communicates with discharge porting 122. Discharge at discharge plate 108 is shown in FIG. 11 and at housing portion 104 is shown in FIGS. 12 and 12A. Since discharge porting 120 operates the same as discharge porting 122, only discharge porting 120 is described in detail below.

Discharge porting 120 comprises a first stepped down portion 124 defined by a line 126 which represents the circumferential distance encompassed when surface 124 intersects inner circumferential surface 111, an edge 128 which follows the root diameter of female rotor 44 and a curved edge 130 which communicates with the periphery of the remaining radial and axial port areas, such areas being well known and defined in the art. This first stepped down portion 124 provides relief on the female rotor side of the aforementioned trapped pocket, since such will be aligned with this portion. A second further stepped down portion 132 depends from stepped down portion 124 and generally aligns with the axial port area of female rotor 44. Both portions 124 and 132 lead into a discharge opening 134 which generally aligns with the radial flow area. The discharge opening from discharge porting 120 and 122 are combined and form a single discharge output for the compressor.

While the above described embodiment has been described with a male rotor having eight lobes, whereby eight discharge pulses per revolution of the male rotor are generated for each of the female rotor for a total of sixteen pulses per revolution, it may be preferred that a male rotor having nine lobes (i.e., an odd number) be employed. The sixteen pulses per revolution actually only generate eight pulses per revolution, since two pulses occur at the same time, i.e., one for each of the female rotors. With a male rotor having nine lobes, eighteen pulses per revolution are generated, i.e., nine pulses per revolution for each of the two female rotors. However, none of these eighteen pulses occur during another one of the pulses, thereby generating a more even or smoother discharge flow, i.e., less noise.

Figure 8:
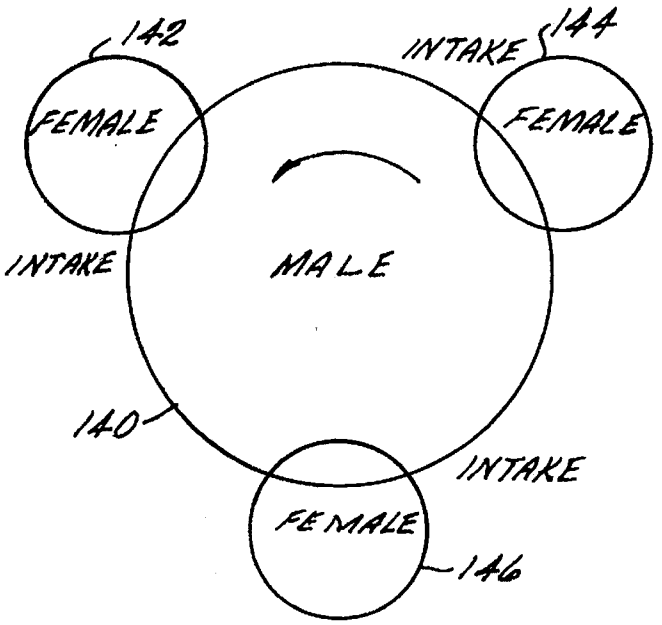
FIG. 8 is a diagrammatic cross sectional view of a multi-rotor configuration in accordance with an alternate embodiment of the present invention.

Further, while the above described embodiment has been described with only two female rotors, it is within the scope of the present invention that two or more female rotors may be employed with a single drive male rotor. Referring to FIG. 8, a cross sectional view of a male rotor 140 is axially aligned with and in communication with three equally spaced female rotors 142, 144 and 146. Male rotor 140 is driven by a motor, as described above. In this example, male rotor 140 has between nine and thirteen lobes (e.g., twelve lobes would have a 100° wrap), female rotor 142 has between four and seven flutes (e.g., six flutes would have 200° wrap), female rotor 144 has between four and seven flutes (e.g., six flutes would have 200° wrap), and female rotor 146 has between four and seven flutes (e.g., six flutes would have 200° wrap). The wrap can easily be determined by the following formula, male rotor wrap=female rotor wrap (no. of female flutes per rotor/no. of male lobes per rotor). Again, the pitch diameters of the female rotors 142, 144, 146 are less than the pitch diameter of the male rotor 140.

Also, while the above example has been directed to a compressor for HVAC use, the muli-rotor configuration of the present invention is equally applicable in other helical type compressors, e.g., compressors with working fluids such as helium, air and ammonia. Moreover, the multi-rotor compressor of the present invention may be extremely well suited for oil less air compression.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A helical-screw rotary compressor comprising:

a first rotor;

at least two second rotors axially aligned with said first rotor, said first rotor in communication with said second rotors whereby said first rotor drives said second rotors, said second rotors being generally equally spaced about said first rotor;

a discharge side plate disposed at a discharge end of said first rotor, said discharge side plate being generally cylindrical and having an outside diameter about the same as a crest diameter of said first rotor; and a compressor housing having said first and second rotors disposed therein, said compressor housing comprising, (1) an induction housing portion, (2) a main housing portion, and (3) a discharge housing portion, said discharge housing portion including, (a) an inner circumferential surface for receiving said discharge side plate with a clearance being defined between said inner circumferential surface and an outer circumference of said discharge side plate, (b) a countersunk surface depending from said inner circumferential surface and terminating at an opening, said countersunk surface depending from said inner circumferential surface allows said clearance to be sealed by a liquid in said compressor, and (c) at least two discharge porting schemes, each positioned for communication with a discharge port area of each corresponding said second rotor.

2. The compressor of claim 1 further comprising:

an induction side plate disposed at an induction end of said first rotor, said induction side plate being generally cylindrical and having an outside diameter about the same as a root diameter of said first rotor.

3. The compressor of claim 1 wherein each of said discharge porting scheme comprises:

a first stepped down portion defined by an intersection of said counter sunk surface and said inner circumferential surface, an edge which generally follows a root diameter of a corresponding said second rotor and a curved edge which communicates with a periphery of remaining discharge port areas of said first rotor and said corresponding said second rotor, whereby said first stepped down portion provides trap pocket relief;

a second stepped down portion depending from said first stepped down portion, said second stepped down portion generally aligned with an axial discharge port area of said corresponding said second rotor; and wherein said first and second stepped down portions lead to a discharge opening generally aligned with a radial discharge area of said first rotor and said corresponding axial discharge port area of said second rotor.

4. The compressor of claim 1 wherein:

said first rotor comprises a male rotor having a plurality of lobes with a degree of wrap; and said at least two second rotors comprise at least two female rotors, each of said female rotors having a plurality of flutes with a degree of wrap.

5. The compressor of claim 4 wherein said at least two female rotors comprises two female rotors.

6. The compressor of claim 4 wherein said at least two female rotors comprises three female rotors.

7. The compressor of claim 4 wherein said male rotor comprises:

a generally cylindrical metal shaft; and a ring having said lobes integrally depending therefrom, said ring disposed on said shaft for rotation therewith, said ring comprised of a composite material.

8. The compressor of claim 1 wherein:

said first rotor comprises a male rotor having a plurality of lobes with a degree of wrap;

said at least two second rotors comprise at least two female rotors, each of said female rotors having a plurality of flutes with a degree of wrap; and a drive motor in communication with said male rotor for driving said male rotor.

9. The compressor of claim 8 wherein said male rotor comprises:

a generally cylindrical metal shaft coupled to said drive motor; and a ring having said lobes integrally depending therefrom, said ring disposed on said shaft for rotation therewith, said ring comprised of a composite material.

10. The compressor of claim 9 further comprising:

an induction side plate disposed at an induction end of said male rotor, said induction side plate being generally cylindrical and having an outside diameter about the same as a root diameter of said male rotor;

a discharge side plate disposed at a discharge end of said male rotor, said discharge side plate being generally cylindrical and having an outside diameter about the same as a crest diameter of said male rotor; and a plurality of dowels attached to said induction and discharge side plates for retaining said ring on said shaft.

11. The compressor of claim 10 wherein:

said dowels are disposed in cooperating grooves formed at an outer surface of said shaft and an inner surface of said ring.

12. A helical-screw rotary compressor comprising:

a first rotor;

a second rotor axially aligned with said first rotor, said first rotor in communication with said second rotor whereby said first rotor drives said second rotor;

a discharge side plate disposed at a discharge end of said first rotor, said discharge side plate being generally cylindrical and having an outside diameter about the same as a crest diameter of said first rotor;

a compressor housing having said first and second rotors disposed therein, said compressor housing comprising, (1) an induction housing portion, (2) a main housing portion, and (3) a discharge housing portion, said discharge housing portion including, (a) an inner circumferential surface for receiving said discharge side plate, with a clearance being defined between said inner circumferential surface and an outer circumference of said discharge side plate, (b) a countersunk surface depending from said inner circumferential surface and terminating at an opening, said countersunk surface depending from said inner circumferential surface allows said clearance to be sealed by a liquid in said compressor, and (c) a discharge porting scheme, positioned for communication with a discharge port area of second rotor, said discharge porting scheme comprising, (1) a first stepped down portion defined by an intersection of said counter sunk surface and said inner circumferential surface, an edge which generally follows a root diameter of said second rotor and a curved edge which communicates with a periphery of remaining discharge port areas of said first rotor and second rotor, whereby said first stepped down portion provides trap pocket relief, and (2) a second stepped down portion depending from said first stepped down portion, said second stepped down portion generally aligned with an axial discharge port area of said second rotor, and wherein said first and second stepped down portions lead to a discharge opening generally aligned with a radial discharge area of said first rotor and said axial discharge port area of said second rotor.

13. The compressor of claim 12 wherein:

said first rotor comprises a male rotor including a plurality of lobes with a degree of wrap; and said second rotor comprises a female rotor having a plurality of flutes with a degree of wrap.

* * * * *